United States Patent [19]

Katz

[11] Patent Number: 4,689,476

[45] Date of Patent: Aug. 25, 1987

[54] MARINER'S DOGLEG COURSE DISTANCE CALCULATOR

[76] Inventor: Joseph Katz, 255 E. Main St., Gloucester, Mass. 01930

[21] Appl. No.: 651,601

[22] Filed: Sep. 17, 1984

[51] Int. Cl.[4] ..... G06C 3/00

[52] U.S. Cl. ..... 235/88 N; 235/61 NV; 235/78 N

[58] Field of Search ..... 235/88 R–88 RC, 235/61 V, 61 NV, 78 N, 61 B; 116/26, 223

[56] References Cited

U.S. PATENT DOCUMENTS

| | | | |
|---|---|---|---|
| 2,901,167 | 8/1959 | Mudge | 235/88 N X |
| 3,063,626 | 11/1962 | Kritsen | 235/88 N X |
| 3,106,030 | 10/1963 | Pelosi | 235/88 G |
| 3,692,238 | 9/1972 | Boyd | 235/88 N |
| 4,456,821 | 6/1984 | Harter | 235/61 NV X |

*Primary Examiner*—Benjamin R. Fuller

[57] ABSTRACT

There is disclosed a marine calculator of the slide rule type whereby the running distance to a destination station over a dogleg or zig zag course may be readily determined from knowledge of the rhumb line course distance and the departure angle of the dogleg or zig zag course.

7 Claims, 5 Drawing Figures

MARINER'S DOGLEG COURSE DISTANCE CALCULATOR

BACKGROUND OF THE INVENTION

The present invention relates generally to navigational calculators and is more specifically concerned with a navigational calculator adapted to provide distance information relating to dogleg or zig-zag courses to a destination station.

The conditions of sea, current and wind are, singly or in combination, essential factors to be taken into consideration in the safe and efficient navigation of vessels. For instance, it is known that navigating a vessel directly into head seas tends to maximize the physical stresses to which the vessel and those aboard are subjected and, in the case of powerboats, often entails the use of increased motor speed (and fuel consumption) in order to overcome the slowing or stalling effect of the head seas acting against the hull of the vessel. In sufficiently severe head sea conditions it is often necessary to slow the vessel to the point of minimum headway in order to safely withstand the physical stresses imposed on the vessel and/or crew. It is also known that operations of a vessel in directly following seas can be troublesome, involving opportunities for broaching and/or pitchpoling of the vessel when it is overtaken by a wave or swell from astern. Thus, powerboat operations in a following sea often require continuous, expert and tiresome attention to throttle modulation in order to maintain the vessel in a safe position relative to the waves or swells. Additionally, in the case of sailboats, a directly known to following wind of less than hull speed is known to result in less than maximum attainable speed of the vessel through the water.

In all of the foregoing instances, where the directions of the head or following seas and/or winds are essentially coaligned with the rhumb line or direct course to the destination station, a known and conventional navigational action is to take up a so-called "dogleg" or zig-zag course comprising a number of alternating course legs. The odd course legs are undertaken at a selected positive or negative relative angle to the rhumb line or direct course and the even course legs are undertaken at an equal, but opposite, relative angle to the rhumb line or direct course. These alternating and equal relative angles of the odd and even course legs are hereinafter collectively referred to as the "departure angle". Thus, the vessel is caused to criss-cross or contact the rhumb line course until the destination station has been reached. The dogleg course comprises only two course legs, the first departing from the rhumb line course while the second approaches the rhumb line course and intersects it at the destination station, the odd and even course legs thereby comprising the legs of an isosceles triangle, the base of which is defined by the rhumb line course. The zig-zag course, on the other hand, while similar in its basics to the dogleg course, comprises course legs whose number, in the aggregate, is greater than two.

By the dogleg or zig-zag course technique, the aforementioned problems of running directly into head or following seas and/or winds are usually substantially ameliorated and, in the case of sailboats whose rhumb line course would dictate running in a following wind of less than hull speed, the speed of the hull through the water is usually substantially increased over that achievable were the rhumb line or direct course to be navigated. Thus, while the dogleg or zig-zag course technique and its advantages are generally well known and understood to skilled mariners, the incremental distances to the destination station occasioned by use of this navigational technique are, practically speaking, rarely ascertained because, heretofore, the multiple trigonometric calculations and summations required to obtain this information have been relatively arduous and time consuming to perform. In accordance with the present invention, however, there is provided a novel navigational calculator in which this distance information, arising from the adoption of a dogleg or zig-zag course to a destination station, is readily and quickly obtainable as a function of the selected departure angle.

While there are, of course, many known navigational calculators, none is known to the present applicant which functions to quickly provide dogleg or zig-zag course distance information as a function of departure angle, as does the calculator of the present invention.

SUMMARY OF THE INVENTION

In accordance with the invention, the calculator hereof is in the general physical nature of a slide rule comprising a fixed base element and an opaque slide element in sliding arrangement with respect to the fixed base element. The base element is provided with a scale of numbered indicia representative of rhumb line or direct course distances to the destination station. Underlying the slide element the base element is also provided with a table of numbered distance indicia comprising discrete running distances to be negotiated to the destination station at a number of dogleg or zig-zag course departure angles. The slide element of the calculator comprises an array of windows or apertures therethrough, each of said windows representing a specific departure angle and being juxtaposable over the individual running distance indicia of the distance table of the fixed base member so as to expose therethrough appropriate dogleg or zig-zag course distance information when said slide element is indexed to a specific rhumb line course distance displayed on said fixed base element. Each window or aperture of the slide element is also provided with reference indicia keying thereto the specific departure angle represented thereby. Means are provided by which to index the slide element to the rhumb line course distance scale of the base element.

DESCRIPTION OF THE PREFERRED EMBODIMETNTS

Referring now specifically to

Figure 1:
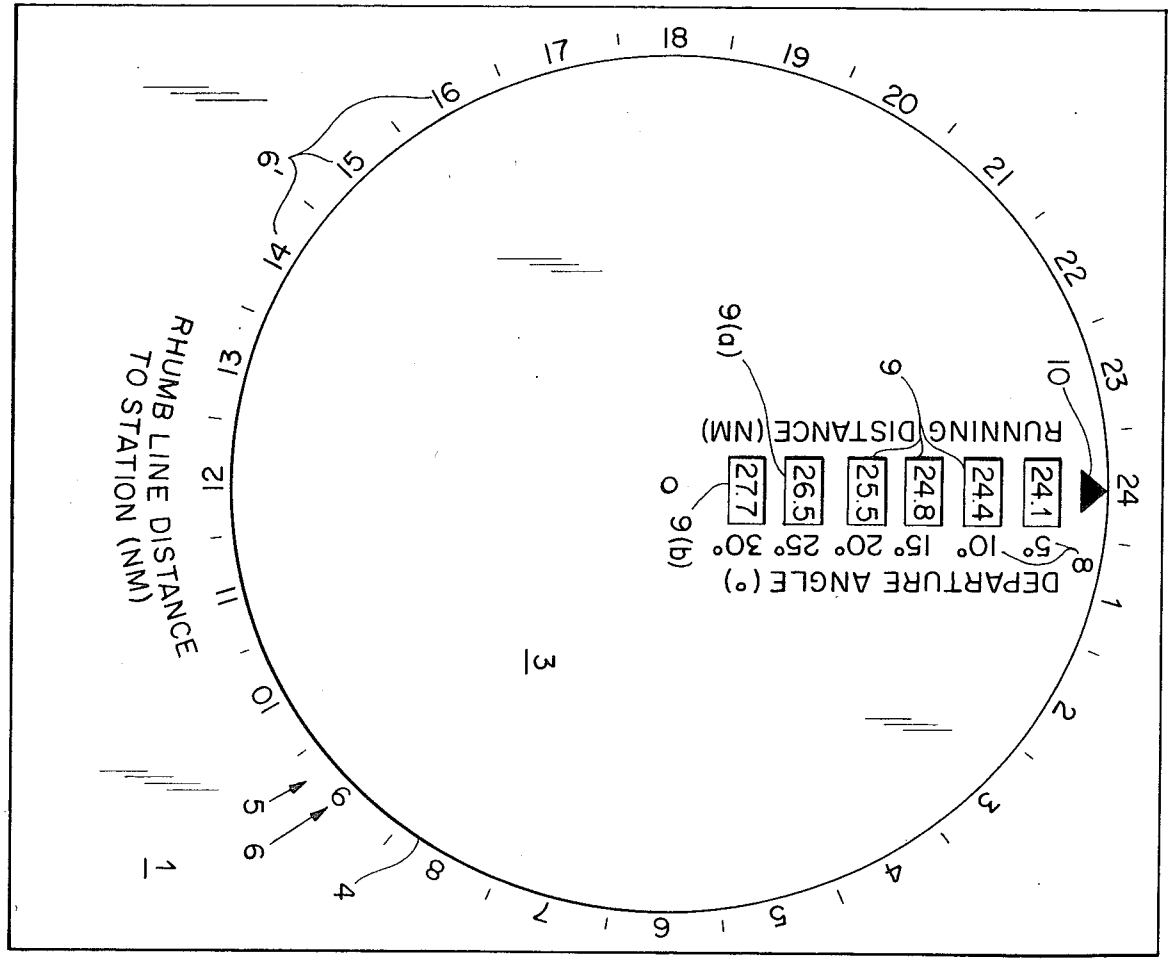
FIG. 1 hereof is a diagrammatic, schematic, plan view of a dogleg or zig-zag course distance calculator in accordance with the invention.
Figure 2:
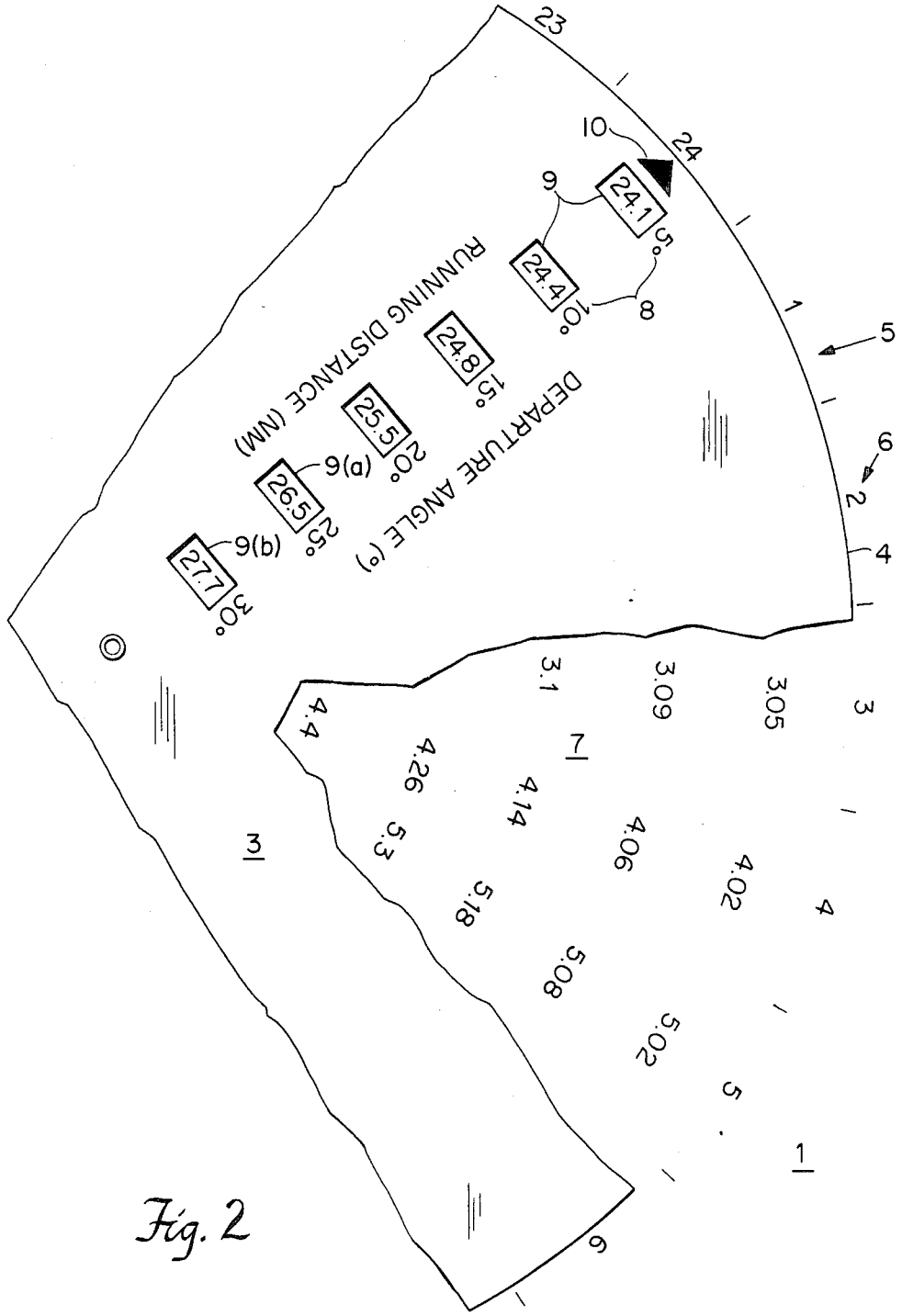
FIG. 2 hereof is an enlarged diagrammatic, partly sectional, schematic, plan view of a portion of the dogleg or zig-zag course distance calculator of FIG. 1.

FIGS. 1 and 2 hereof, wherein like reference numerals refer to like elements the calculator of the invention is broadly in the nature of a slide rule device comprising a fixed base element 1 having slidingly affixed thereto an opaque slide element 3. Desirably, for purposes of economy of space and ease of operation, the calculator of the invention is in the nature of a circular slide rule wherein the slide element 3 takes the form of a circular disk 4 having a diameter sufficiently less than the surface of said fixed base element 1 as to provide said fixed base element 1 with circumferential margin 5 immediately surrounding the periphery of the disk 4. Scale 6, representing rhumb line or direct course distances to the destination station, is located on the margin 5 of the fixed base element 1 with the numerical distance indicia 6' thereof being arranged in serial order.

That portion of fixed base element 1 underlying the opaque slide element 3 bears thereon a table 7 of numbered distance indicia, each number thereof representing a running distance to be negotiated over a zig-zag or dogleg course to a destination station. The running distances of table 7 are arranged so as to coact with the windows or apertures 9 of the slide element 3 of the calculator as will be explained in greater detail hereinafter.

Opaque slide element 3 comprises a plurality of windows 9 therethrough, each of which windows 9 is representative of a different departure angle and is arranged with respect to the running distance indicia of table 7 as to expose therethrough the correct dogleg or zig-zag course running distance upon indexing of the slide element 3 to the selected rhumb line course distance of scale 6. In addition, the slide element 3 comprises departure angle reference indicia 8 which key each window 9 to the particular dogleg or zig-zag course departure angle represented by that window. For example, in FIGS. 1 and 2 window 9(*a*) represents a departure angle of ±25° while window 9(*b*) represents a departure angle of ±30°. As mentioned previously, "departure angle" is defined as the relative angle of the dogleg or zig-zag course legs with respect to the rhumb line or direct course. Thus, said departure angle will be negative relative to the rhumb line course for one of the two course legs and will be equal, but positive, relative to the rhumb line course for the other of said course legs.

The slide element 3 of the calculator of the invention also comprises means by which to index said element 3 to the selected rhumb line course distance of scale 6. Any means by which said indexing function may be accomplished is suitable for purposes of the invention. For instance, perhaps the simplest of such means is a mark or dart 10 suitably located at the perimeter of the slide element 3. However, other full equivalents of the dart 10 for use as the indexing means will be apparent to those of skill in the art. For instance, at the expense of some added complexity, the indexing means can comprise a transparent cursor element extending from the periphery of the slide element 3 and having scribed thereon an indexing or cursor line. Alternatively, slide element 3 can be of a size sufficient to overlie the rhumb line scale 6 of fixed base element 1 and can be provided with an indexing notch or cutout in the edge thereof of sufficient size and depth to expose therethrough discrete rhumb line distances of scale 6.

In use, the mariner contemplating a dogleg or zig-zag course to the destination station need know only the rhumb line course distance from the point at which the dogleg or zig-zag course is proposed to be begun and the departure angle selected therefor. This rhumb line course distance to the destination station may be readily ascertained by measurement thereof on a suitable nautical chart. Then, the slide element 3 of the calculator is indexed to the so measured particular rhumb line distance of scale 6 and the true running distance to the destination station, as a function of the selected departure angle, can be immediately observed through that window 9 of the slide element 3 representative of the selected departure angle.

Figure 3:
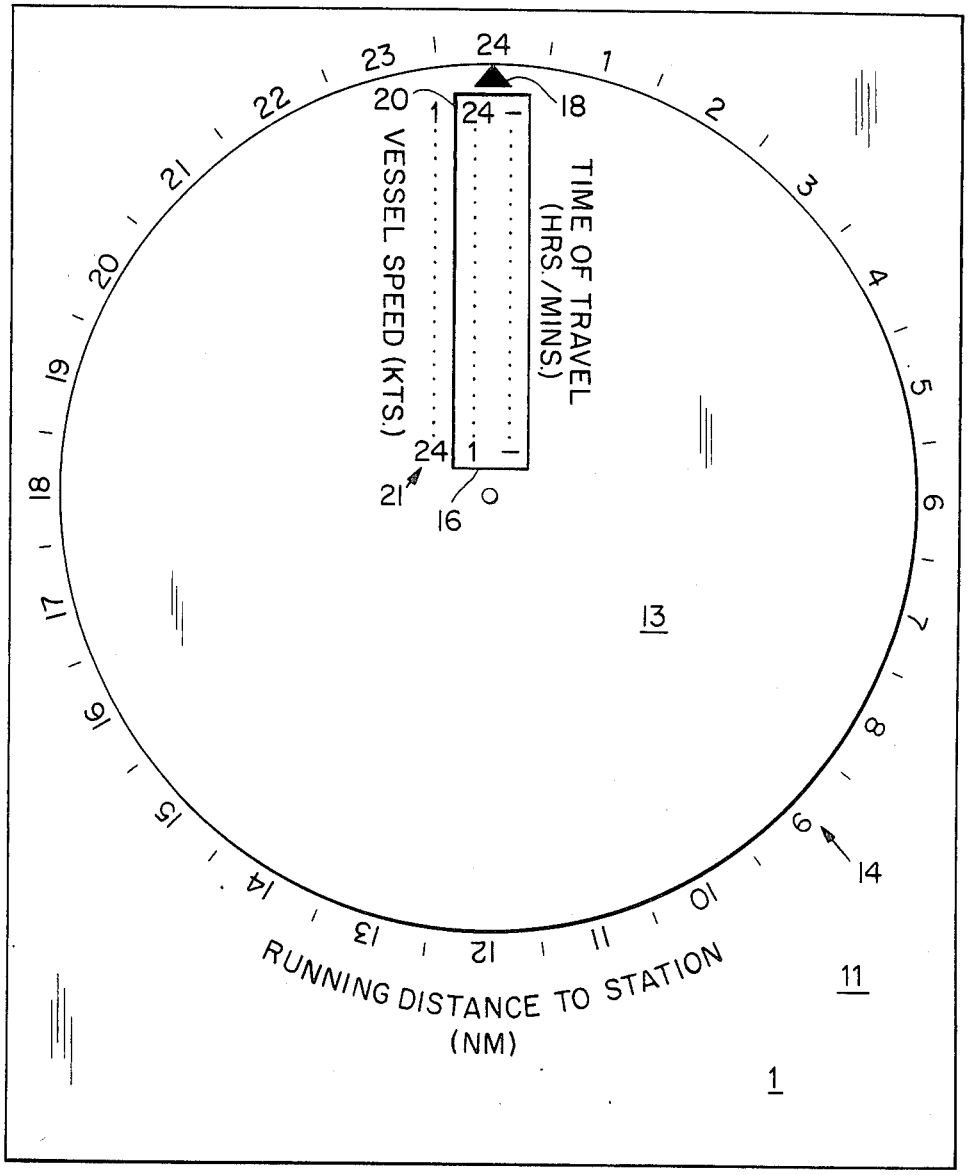
FIG. 3 hereof is a diagrammatic, schematic, plan view of the obverse side of the calculator of FIG. 1 disclosing a preferred embodiment of the invention wherein said obverse side comprises a time-rate-distance calculator.
Figure 4:
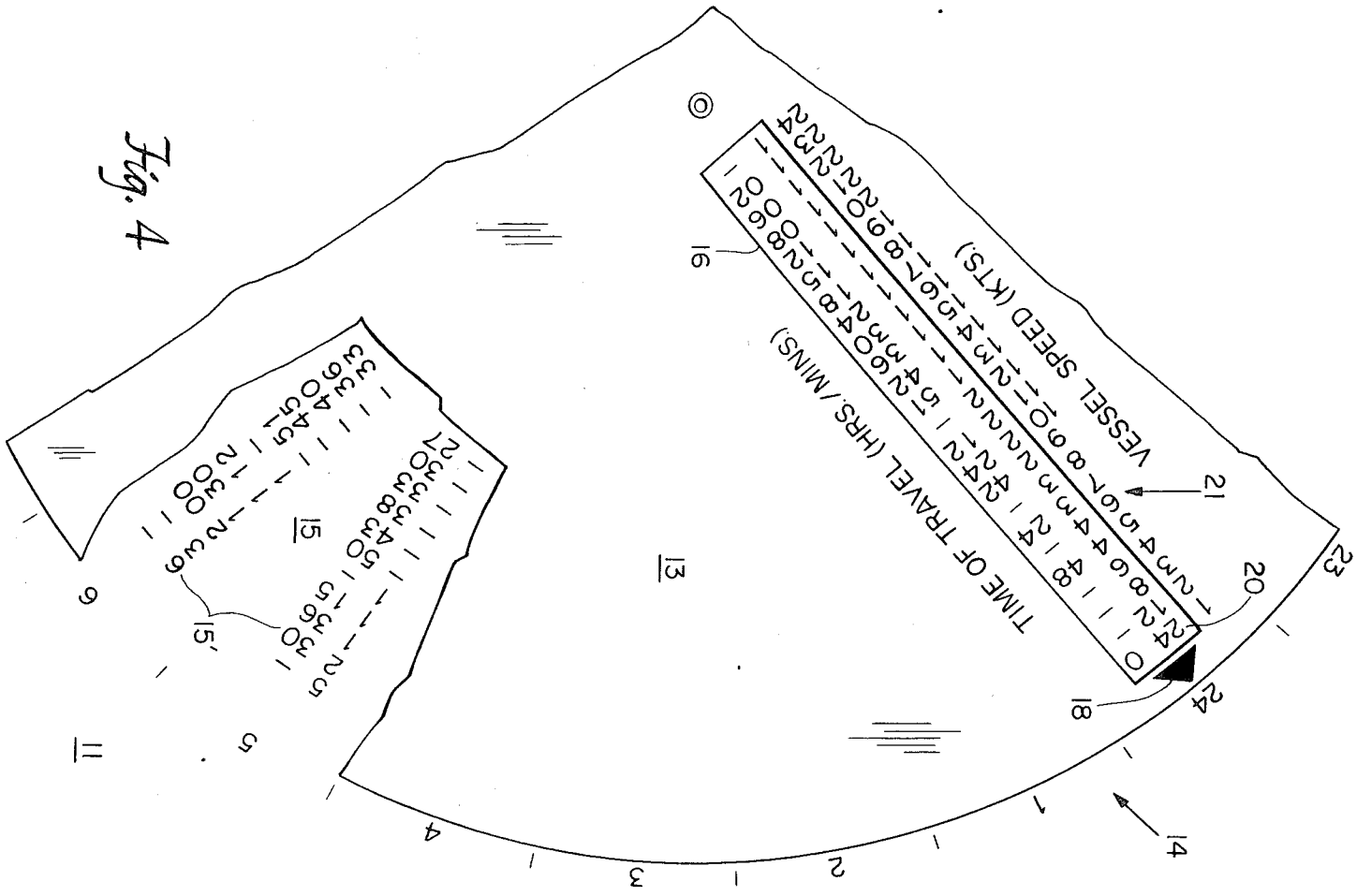
FIG. 4 hereof is an enlarged diagrammatic, partly sectional, schematic, plan view of a portion of the time-rate-distance calculator of FIG. 3.

In a preferred embodiment of the invention, the obverse side portion of the calculator is provided with a time-rate-distance calculator function. Such calculators are well known and require no extensive discussion herein. In the particular embodiment of the invention shown in FIGS. 3 and 4, wherein like reference numerals refer to like elements, said time-rate-distance calculator portion is broadly comprised of the obverse side 11 of the fixed base element 1 and a second opaque disk slide element 13 affixed thereto. A serially numbered scale 14, representative of running distances to the destination station, is arranged on side 11 of fixed base element 1 exterior of and around the perimeter of the disk slide element 13. A time table 15, comprising radially oriented sets 15' of discrete times of travel to the destination station, is arranged on that portion of the side 11 underlying the second opaque disk slide element 13. The second disk slide element 13 comprises an elongate radially oriented window 16 through which the sets 15' of table 15 are selectively exposed upon indexing of said second disk element 13 to the selected running distance of the scale 14. In addition, the second disk slide element 13 is also provided, as explained in reference to the dogleg or zig-zag course distance calculator portion of the invention, with suitable indexing means, such as a dart or mark 18, by which said slide element 13 can be properly indexed with respect to the selected running distance of scale 14, thereby to expose the appropriate time of travel set 15' of table 15 through the window 16. Adjacent at least one margin 20 of the window 16 there is provided a speed scale 21 comprising a plurality of speeds representative of a range of vessel speeds, each said speed being arranged so as to be in side-by-side correspondence with the appropriate time of travel of the set 15' appearing through window 16. A mariner having knowledge of the running distance to be traveled to a destination station can determine the time of travel to said station by indexing the second disk slide element 13 to the running distance of scale 14. Vessel speed over the sea bottom is usually readily determinable either by reference to the vessel's instruments or by logging. Thus, the time to reach the destination station is then readily determined by reading from that set 15' of the time of travel table 15 exposed through the window 16 and by taking as the response that discrete time of travel of the exposed set 15' which is in side-by-side correspondence with the vessel's speed over the sea bottom appearing in speed scale 21. Of course, those of skill in the navigation art will recognize that the time-rate-distance calculator portion of the calculator of the invention can be manipulated in many other ways as to solve any time-rate-distance problem wherein any two of the three parameters of the Distance =Time×Rate equation are known.

Figure 5:
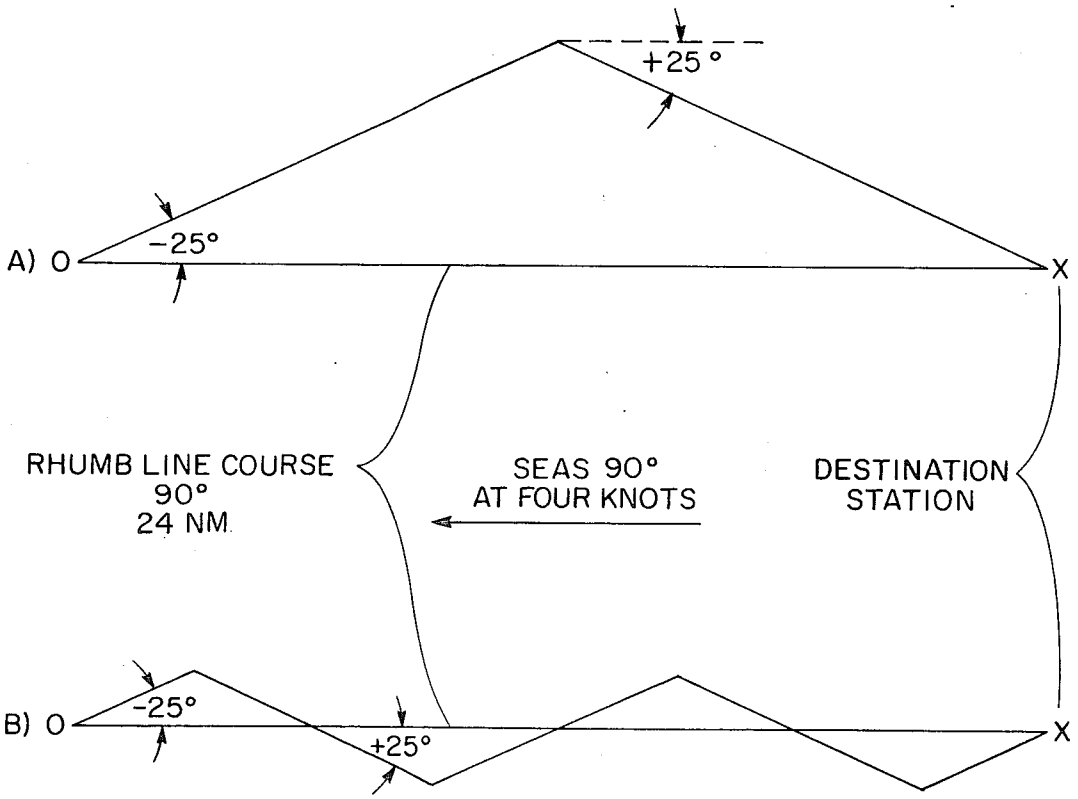
FIG. 5 hereof depicts two diagrammatic, schematic, exemplary, non-limiting hypothetical plots A and B of rhumb line magnetic courses to destination stations and typical dogleg or zig-zag courses thereto.

As a practical but non-limiting hypothetical example of the present invention in operation, reference is now made to FIG. 5 wherein there are depicted two plots, A and B, in each instance of which a vessel is to make good a rhumb line course of 90° magnetic to a destination station 24 nautical miles away. Assuming the seas to be heavy and running at a speed of 4 knots directly from the east, it is clear that such a vessel steering the rhumb line course would be subjected to maximum operational stresses and that the speed thereof, over the sea bottom, would be adversely affected. Given a vessel speed through the water of, say, 12 knots, use of the time-rate-distance calculator portion of the calculator as generally described above reveals that the time of travel to the destination station to be expected by steering the rhumb line course at a resultant overall speed over the sea bottom of 8 knots will be 3 hours. Now, if a dogleg (A) or zig-zag (B) course to the destination station is undertaken at a departure angle of ±25°, reference to the course distance calculator portion of the calculator of the invention and manipulation thereof in the manner hereinbefore described reveals that the total running distance to be negotiated by adoption of such a dogleg or zig-zag course will be 26.5 nautical miles. It should be noted that said course distance will be essentially the same whether the two-course leg dogleg course plotted in A or the multiple course leg zig-zag course plotted in B is employed. By adoption of either of the proposed dogleg or zig-zag courses A or B, the speed of the vessel over the sea bottom, with no increase in engine speed or fuel consumption, can be expected to increase to about 10 knots. Because the time-rate-distance calculator portion of the particular embodiment of the invention shown in FIG. 2 bears a maximum distance on the running distance scale 14 thereof of only 24 miles, the determination of the overall running time for course A or B will require determination of the times of travel for two distances whose sum equals 26.5 miles. Accordingly, for example, the times of travel for 24 miles and 2.5 miles, each at 10 knots speed, are determined and summed. Thus, utilizing the time-rate-distance calculator portion of the calculator of the invention and indexing disk 13 thereof to a running distance of 24 nautical miles of the scale 14, the resulting time of travel is read from the set 15' of table 15 appearing through window 16 as that discrete time of travel in side-by-side correspondence with the speed of 10 knots appearing in speed scale 21, said time of travel being 2 hours 24 minutes. Next, the calculator is reindexed to 2.5 miles and the time of travel at a speed of 10 knots is determined to be 15 minutes by interpolation of the times of travel appearing in the 2 and 3 mile sets 15'. The total running time, therefore, is 2 hours 24 minutes plus 15 minutes=2 hours 39 minutes. Accordingly, by taking up the proposed dogleg or zig-zag courses (A) or (B) at a departure angle of 25°, the navigator of the vessel not only reduces the stresses imposed on the vessel and crew, but also shortens the time of travel to the destination station by about 21 minutes.

Now, assuming hypothetically that the 12 knot speed of the vessel through the water under rhumb line course conditions is a reduced speed condition necessitated by concerns of safety and comfort of the vessel and crew, the taking up of a dogleg or zig-zag course to the destination station can also represent an opportunity to increase motor and vessel speeds in order to recapture at least a part of this reduction in the vessel's speed through the water. In this eventuality, of course, the savings in running time to the destination station as a result of the taking up of the dogleg or zig-zag course can be even greater than that of the foregoing hypothetical example and can be equally well and quickly determined by use of the calculator of the invention.

What is claimed is:

1. A mariner's dogleg or zig-zag course distance calculator comprising:

a fixed base element and an opaque slide element in sliding overlying arrangement with respect to at least one side of said fixed base element;

said fixed base element having on said one side thereof a rhumb line course distance scale and, underlying said slide element, a table of discrete dogleg or zig-zag course running distances;

said opaque slide element comprising means to index said slide element to discrete rhumb line course distances of said rhumb line course distance scale, a plurality of windows therethrough, each said window being representative of discrete departure angle of the dogleg or zig-zag course, and departure angle indicia referencing each said window to the discrete departure angle represented thereby;

said discrete dogleg or zig-zag course distances of said table and said windows being arranged such that, upon indexing of said slide element to a rhumb line course distance of said rhumb line course distance scale, each said window exposes therethrough the dogleg or zig-zag course running distance corresponding to (a) the departure angle represented by said window and (b) the rhumb line course distance to which said slide element is indexed.

2. The calculator of claim 1 wherein said slide element is in the nature of a circular disk.

3. The calculator of claim 1 wherein said rhumb line course distance scale is located exterior of and adjacent the perimeter of said slide element.

4. The calculator of claim 2 wherein said rhumb line course distance scale is located exterior of and adjacent the perimeter of said slide element.

5. The calculator of claim 1 wherein said means to index said slide element comprises a mark located on the perimeter of said slide element disk.

6. The calculator of claim 2 wherein said means to index said slide element comprises a mark located on the perimeter of said slide element disk.

7. The calculator of claim 1 wherein the obverse side thereof comprises a time-rate-distance calculator.

* * * * *